United States Patent [19]

Harris

[11] Patent Number: 5,005,023

[45] Date of Patent: Apr. 2, 1991

[54] DUAL BAND INTEGRATED LNB FEEDHORN SYSTEM

[75] Inventor: James M. Harris, Terrell, Tex.

[73] Assignee: Gardiner Communications Corporation, Garland, Tex.

[21] Appl. No.: 278,589

[22] Filed: Dec. 1, 1988

[51] Int. Cl.[5] ..... H01Q 19/00; H01Q 13/00; H01P 1/16; H01P 5/12

[52] U.S. Cl. ..... 343/756; 333/21 A; 333/135; 343/766; 343/776; 343/786

[58] Field of Search ..... 343/762, 772, 771, 773, 343/776, 786; 333/21 R, 21 A, 135, 761, 839

[56] References Cited

U.S. PATENT DOCUMENTS

| | | | |
|---|---|---|---|
| 4,538,175 | 8/1985 | Balbes et al. | 343/786 |
| 4,614,924 | 9/1986 | Kamitz et al. | 333/12 |
| 4,642,479 | 2/1987 | Lombardi et al. | 333/24 R |
| 4,740,795 | 4/1988 | Seavey | 343/786 |
| 4,785,306 | 11/1988 | Adams | 343/786 |
| 4,801,945 | 1/1989 | Luly | 343/786 |
| 4,819,005 | 4/1989 | Wilkes | 343/786 |
| 4,821,046 | 4/1989 | Wilkes | 343/786 |
| 4,841,261 | 6/1989 | Augustin | 333/21 A |
| 4,847,574 | 7/1989 | Gauthier et al. | 333/21 A |
| 4,903,037 | 2/1990 | Mitchell et al. | 343/756 |

*Primary Examiner*—Rolf Hille
*Assistant Examiner*—Peter Toby Brown
*Attorney, Agent, or Firm*—Hubbard, Thurman, Tucker & Harris

[57] ABSTRACT

A dual band integrated feedhorn includes a housing having a rotatable support for a C band coaxial waveguide, a clamp for a Ku band waveguide, a Ku band waveguide slideably mounted in the clamp for focus adjustment, and a pair of low noise blocks connected to the waveguide output probes for downconverting their incoming modulated carrier C and Ku band signals to modulated IF signals. A servo drives the support member to position the waveguides energy output coupling probes to match the polarization of the incoming RF energy; thus, eliminating the need for polarizers and reducing insertion loss significantly. The reduced insertion loss enables defocusing of the Ku band waveguide to widen the half power beamwidth to improve aiming accuracy without decreasing the gain and degrading performance. A position adjustable scalar and a pair of power modules are attached exteriorly of the housing. The scalar is positioned adjacent the end of the C band waveguide for focusing the C band waveguide. The power modules include transient suppressors and voltage regulators connected to the pair of low noise blocks for suppressing incoming transients and regulating the incoming dc voltage while outputting the modulated IF carrier signals. Thus, heat generated by the power modules is kept from the low noise blocks, resulting in improved operating performance and increased life.

5 Claims, 2 Drawing Sheets

DUAL BAND INTEGRATED LNB FEEDHORN SYSTEM

This invention relates to communication microwave devices and more particularly to a dual band integrated low noise block (LNB) feedhorn system.

BACKGROUND OF THE INVENTION

Microwave communication systems include one or more satellites receiving signals transmitted to it by an earth station. The satellites amplify and send this information to other earth stations on new carrier frequencies. A frequency difference of about 2 GHz prevents interference between the uplink and downlink transmissions. For example, all geostationary satellites operate in one of the following three bands:

| Old Band | Uplink | Downlink | Orbit Separation |
|---|---|---|---|
| C | 6 GHz | 4 GHz | 4 degrees |
| Ku | 14 GHz | 12 GHz | 3 degrees |
| K | 17 GHz | 12 GHz | Not assigned |

In certain earth locations such as the United States the communication systems operate at C band; while, in Europe the communication systems operate at Ku band. It is becoming increasingly desirable for earth stations to receive the programs of both the C band and Ku band.

Known earth stations include a parabolic (dish) reflector for collecting the microwave energy transmitted by the satellite. The dish focuses the reflected energy on a feedhorn assembly located at a focal point in front of the dish. An entire feedhorn assembly typically includes a feedhorn, a section of waveguide, a polarizer, and a low noise amplifier (LNA) plus associated cable. The LNA circuitry includes a power module for protecting the circuit against power surges or spikes. The power module is typically included in the LNA package which adds to the bulk and weight of the feedhorn assembly as well as to the heat generated in the LNA package. The heat dissipated during a power surge can destroy the LNA which it was designed to protect.

The microwave energy transmitted by satellites typically is polarized vertically and horizontally to double the number of transponders available. A good example of the use of dual polarization on a satellite is the RCA Statcom IIIR which operates at C band (4 GHz) with 24 transponders. The twelve odd-numbered transponders utilize the vertically polarized electric field, and the twelve even-numbered transponders utilize the horizontally polarized electric field. Polarizers increase substantially power insertion losses.

At an earth station receiving site it is necessary to adjust the polarization of the receiving antenna to correspond to the polarization of the set of transponders generating the desired signals in order to receive those signals. Some earth station antennae have dual polarized feeds which are capable of receiving both polarizations simultaneously and thus can receive any or all of the 24 transponders with no further adjustment of the antenna feed. Such dual systems, however, are very expensive which prohibits their use in the private segment of the commercial market. Nevertheless, even for this application, the antennae should be capable of receiving television programs from all of the satellites and from all of the transponders on each of the satellites. Thus, for best results (pictures) the antenna must be capable of responding to either horizontal polarization or vertical polarization of the frequency bands being used, namely, the C and Ku bands. Also, some satellites may have their polarizations skewed from either the vertical or horizontal positions. In this case the antenna must be positioned to respond to the signals having skewed polarizations.

Early earth station designs utilized a motor to rotate the entire feed assembly. The motor is controlled by the operator to position the feed assembly such that its polarization coincides to that of the transmitting satellite. However, the feed assembly was bulky and heavy; thus, rotation of the feed assembly without wobble by the motor drive was difficult. Any wobble of the feedhorn during rotation caused the antenna beam to depart from true boresight along the focal axis, and the signal from the satellite was not in the maximum of the receiving antenna pattern. To alleviate the wobble problem, efforts were directed toward obtaining the desired polarization using a stationary feed assembly. In addition, wind forces result in decreased aiming accuracy and a loss of the incoming signals.

These efforts included the use of a septum in the rotating waveguide. A septum is a metal plate positioned across the waveguide. The lines of an electric field are all normal to a plane which passes horizontally through the center of the waveguide. In a circular waveguide the plane is the horizontal diameter. When properly aligned, the septum will not block or attenuate the wave nor will it cause reflections to occur so long as it is a relatively thin conducting sheet. The septum can be of any length, and the wave as it travels through the guide will reform after it has passed by the septum into a wave identical to the original wave. In effect the electric field lines being normal to the septum do not see the septum, and the wave is said to be cross polarized with respect to the septum.

Another form of the septum included spaced diametric conducting pins mounted across the diameter of the circular waveguide in the same plane as the previously described septum, and spaced along the longitudinal axis of the guide in relatively close proximity (small fractions of a wavelength) one to another. Each pin was slightly rotated a few degrees (only enough to prevent discontinuities) and a gradual rotation of the polarization began without upsetting the wave propagation in the waveguide. If the pins themselves are rotated as described in U.S. Pat. Nos. 3,287,729 and 3,296,558, the entire feed assembly need not be rotated.

To avoid the need for a complex pin rotational mechanism, a twistable serpentine-shaped filament was developed. The filament comprises a series of interconnected legs for transverse orientation to wave propagation at the diameter of a circular waveguide. Each leg is approximately equal in length but slightly less than the diameter of the waveguide. The filament terminates in a leg at each end. One end leg is rigidly mounted to the wall of the desired waveguide input to the LNA, and the other end is securely fastened to a rotatable sleeve for rotation around the longitudinal axis of the waveguide. Thus, the only driven element is the leg nearest the aperture of the feed. The serpentine shape of the filament assures accurate leg-to-leg spacing and successively small progression of leg-to-leg rotation. By appropriate selection of a resilient material, rotation of the legs of the filament is repeatable. More information about the serpentine filament is given in U.S. Pat. No. 4,503,379.

The disadvantage of the above-described feed assembly structures include their rotational-prohibitive size and weight, the substantial power insertion loss attending the use of septums as polarizering elements, heat destruction of the low noise amplifier (LNA) or low noise "block" (LNB) or module resulting from including the power regulator within the LNA or LNB where heat generated by regulating high voltages or transients destroys not only the power regulator but also the LNA or LNB; and decreased aiming accuracy attending the narrow half power beamwidth produced by these systems. A LNB is a LNA combined with a frequency downconverter and IF amplifier for producing modulated IF signals.

SUMMARY OF THE INVENTION

Accordingly it is an object of the present invention to provide a dual band integrated low noise block (LNB) feedhorn system of a weight and size suitable for use as an earth station feed assembly receiving with substantially reduced wobble power generated at two different frequency bands by a communication satellite.

Another object of the invention is to provide a dual band integrated LNB feedhorn system having substantially reduced power insertion loss.

Yet another object of the invention is to provide a dual band integrated LNB feedhorn system configured to reduce substantially heat damage resulting from power surges and to reduce maintenance time and cost.

Still another object of the invention is to provide a dual band integrated LNB feedhorn system having at one band an increased half power beamwidth thereby reducing the aiming accuracy requirement for the antenna.

A further object of the invention is to provide a dual band integrated LNB feedhorn system having increased performance.

Briefly stated the dual band integrated LNB feedhorn system in accordance with the subject matter of the invention comprises a feedhorn assembly having a rotatable subassembly including first and second concentrically formed waveguides and first and second low noise blocks (LNB's) connected to power extraction probes mounted in the waveguides. The power extraction probes, when the subassembly is rotated, provide polarization corresponding to the polarization of a transmitter with substantially reduced power insertion loss.

The reduced insertion loss enables defocusing of the Ku band waveguide to widen the half power beamwidth of the incoming modulated carrier signals to improve aiming accuracy without decreasing the gain and degrading performance. The C band waveguide has an adjustable scalar for focusing at the focal point of the antenna dish.

Power modules are provided outside the LNAs or LNBs for transferring heat directly to the atmosphere and for ready replacement when destroyed by power surges.

BRIEF DESCRIPTION OF THE DRAWINGS

Other objects and features of the invention will become more readily apparent from the following detailed description when read in conjunction with the accompanying drawings in which.

DETAILED DESCRIPTION OF THE PREFERRED EMBODIMENT

Figure 1:
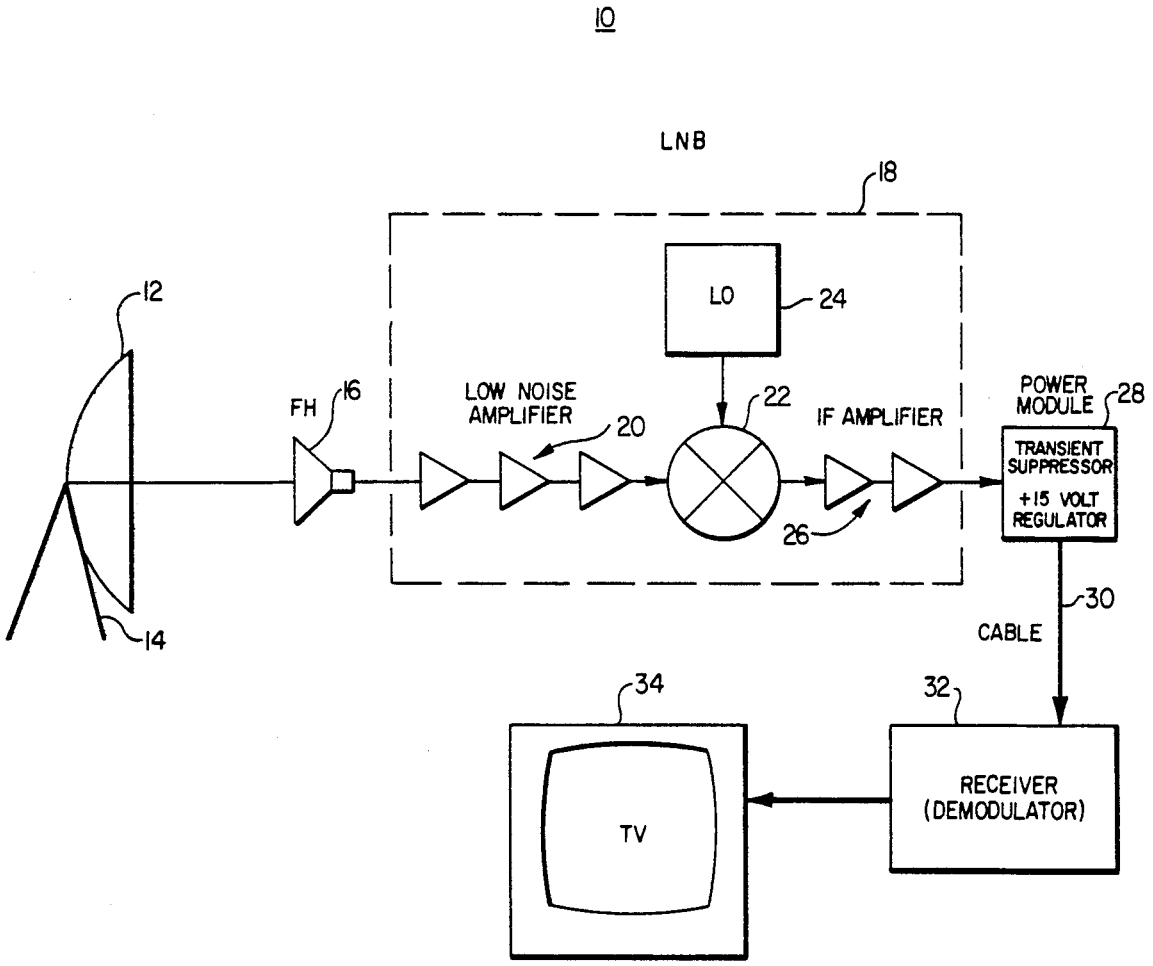
FIG. 1 is a block diagram of the dual band integrated LNB feedhorn system in accordance with the subject matter of the invention.
Figure 2:
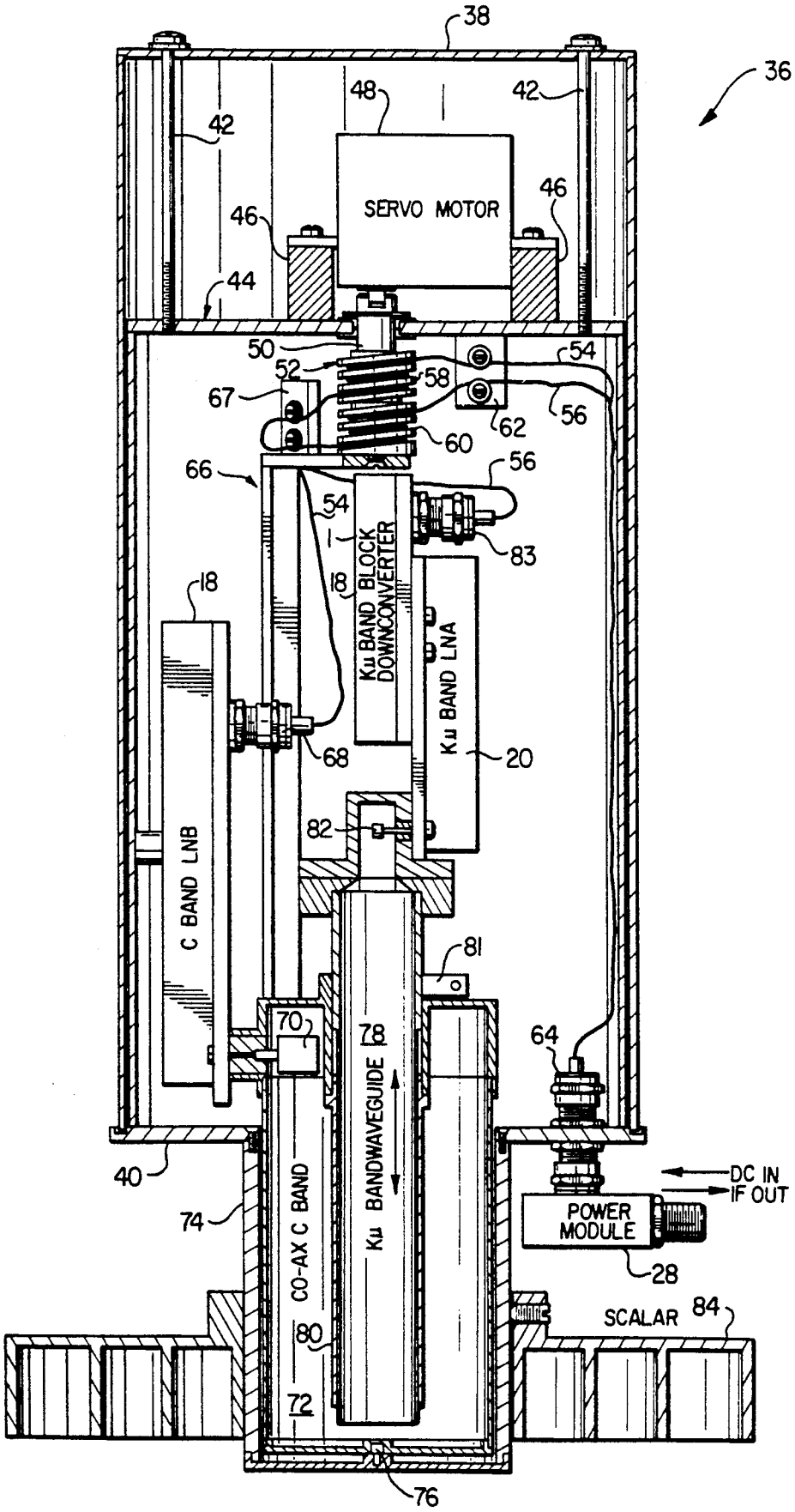
FIG. 2 is a sectional view of the dual band integrated LNB feedhorn system in accordance with the subject matter of the invention.

Referring now to FIGS. 1 and 2, a description of the preferred embodiment of the present invention is given.

The earth station 10 of a communication satellite system includes a parabolic reflector (dish) 12 mounted upon a support 14 for illumination by a communications satellite transmitting modulated r-f signals at, for example, C band and Ku band frequencies. A dual band feedhorn 16 is mounted at the focal point of the dish for receiving the reflected energy for two block downconverters (BDCs) 18-one for each band.

Each block downconverter is, for example, a Gardiner Communications Corporation 200-9545-001 device. The device includes a three-stage low noise amplifier 20 for amplifying the incoming signals to a working level, a mixer 22 connected to a local r-f oscillator 24 for combining the incoming modulated r-f signal with the signal of the local r-f oscillator to produce a modulated i-f signal, and a two stage intermediate frequency (IF) amplifier 26 for amplifying the IF signals to a working level.

A pair of power modules 28 are connected to the outputs of the block downconverters 18. Each power module includes a transient suppressor and a +15 volt regulator connected by a coaxial cable 30 to a receiver (demodulator) 32. The power modules pass the modulated IF signals to the receiver (demodulator) and receive dc power through the inner conductor of the coaxial cables 30 for the block downconverter. As the receiver (demodulator) may be at any distance from the power module, the dc voltage may be for a maximum distance between the demodulator and power module (about 500 ft.); thus, the power modules regulate the dc power received and suppress any transient voltage received to protect the block downconverter from destructive voltages and heat generated by power modules.

The receiver (demodulator) 32 is selectively connected to one of the two bands for outputting TV channel 3 or 4 signals to a television set 34, for example, for processing. A suitable receiver (demodulator) is a Satellite Technology Services receiver model SR 100.

Referring now to FIG. 2, a preferred embodiment of the dual band integrated LNB feedhorn system of the present invention is shown. A cylindrical housing 36 which may be of aluminum or plastic has first and second opposing ends 38 and 40. The first end 38 supports an inverted U-shaped support 44 by screws 42. The cross-arm has servomotor mounts 46 extending upwardly towards the first end 38 and walls forming a centrally disposed aperture between the motor mounts. A servomotor 48 is attached to the motor mounts with its drive shaft 50 extending downwardly through the aperture. A power cable takeup spool 52 is attached to a lower portion of the drive shaft. IF power connecting cables 54 and 56 are wound upon the spool in grooves 58 and 60. Coaxial cables 54 and 56 have first portions attached to a cable retainer 62 by corresponding fastener screws The cable retainer 62 is attached to the cross bar of the U-shaped member 44. The ends of the first portions of the cables 54 and 56 are attached to a pair of coaxial cable connectors 64 attached to apertures forming walls of the second end 40 of housing, 36. Only one of the connectors 64 is shown in FIG. 2. The pair of power modules 28, of which only one is shown, are connected to the pair of power connectors 64 exteriorly of the housing 36.

The drive shaft 50 has its end opposite the motor attachment end fastened to a horizontally disposed arm of support member 66. Support member 66 is rotated by any rotation of the drive shaft. A cable retainer 67 is attached to the horizontally disposed arm of support member 66 and the cables 54 and 56 have second portions fastened to the cable retainer. A vertically disposed leg of support member 66 supports a cable connector 68 for connecting coaxial cable 54 to a C band low noise block downconverter (FIGS. 1 and 2) 18 for receiving the modulated IF signal output.

The input to the C band LNB 18 is connected to a probe 70 of a C band coaxial cable waveguide 72 forming a portion of feedhorn 16. The C band waveguide has a first end attached to the leg of support member 66, a body portion extending downwardly into a cylindrically cup-shaped member 74 attached to aperture forming walls of end 40 of housing 36, and a second end having a pivot 76 mounted in the bottom of the cup-shaped member for rotation support. The end of the C band coaxial waveguide is to be positioned at the focal point of the dish 12.

A Ku band waveguide 78 forms the remainder of the feedhorn 16. The Ku band is slideable mounted in the inner conductor 80 of the C band coaxial waveguide 72 for proper defocusing. A clamp 81 secures the Ku band waveguide in its proper position. A probe 82 connects the output of the Ku band waveguide to a Ku band low noise amplifier 20, which in turn is connected to a Ku band block downconverter 18' including the mixer 22, local oscillator 24, and IF amplifier 26 (see FIG. 1) which together with the LNA forms the block downconverter 18. The output of Ku band block downconverter 18' is connected through coaxial cable connector 83 to coaxial cable 56.

Finally, a scalar 84 is adjustably connected to the cylindrically cup-shaped member 74. The scalar prevents energy approaching the feedhorn as noise from the rear from entering the feedhorn.

In operation, the insertion loss is significantly reduced by eliminating polarizing elements. The dual band integrated LNB feedhorn system is equipped for independent C band and Ku band focusing. The feedhorn system is attached with the end of the C band waveguide at the focal point of the parabolic reflector 12, and the Ku band waveguide is defocused in an amount to allow for wider half-power beamwidth without significantly affecting the gain of the Ku band feed system. The result is that neither the C band nor the Ku band performance is sacrificed. In addition, the aiming accuracy of the Ku band is improved by defocusing to increase the half power beamwidth.

With the C band waveguide focused and the Ku band properly defocused, the servomotor 48 is actuated by a remotely positioned controller to rotate the C band and Ku band waveguide to align their energy output probes with the polarization of the incoming modulated RF energy. Thus, the output probes combine their normal output function with the polarizer function of polarizers to obtain a power savings sufficient to provide a wider than normal half power beamwidth. This result increases the aiming accuracy and compensates for the defocusing of the Ku band without significantly affecting its gain.

Although only a single embodiment of this invention has been described, it will be apparent to a person skilled in the art that various modifications to the details of construction shown and described may be made without departing from the scope of this invention.

What is claimed is:

1. A multi-band integrated LNB feedhorn system comprising: a housing having a body portion and first and second ends, a first support means attached to the housing adjacent to the first end for forming a drive motor portion of the housing, a servomotor mounted on the first support means, a second support means contained in the body portion of the housing and connected to the servomotor for rotation, a plurality of power modules exteriorly attached to the housing, a plurality of low noise block means attached to the second support means for rotation therewith and electrically connected to the plurality of power modules, a cup-shaped member attached to the second end of the housing for forming with a portion of the housing a compartment for a plurality of waveguide means including a plurality of energy output coupling means electrically connected to the plurality of low noise block means, and first and second waveguide means attached to the second support means for rotation therewith, a focusing means, the first waveguide means connected to the focusing means for focusing modulated RF signals at a first band received from an antenna, a defocusing means, the second waveguide means connected to the defocusing means for defocusing modulated RF signals at a second band received from the antenna, whereby with the band of the first waveguide means being focused and the band of the second waveguide means being defocused and the second support means rotated by the servomotor to align the first and second waveguide means and plurality of low noise block means with the polarization of incoming modulated RF energy, the first and second waveguide means and plurality of low noise block means combine to perform the polarizer function thereby alleviating the need for additional polarizing elements and their power loss to provide a power savings sufficient for a wider than typical half power beamwidth for increasing the aiming accuracy while compensating for the defocusing of the band of the second waveguide means without substantially affecting its gain.

2. A multi-band integrated LNB feedhorn system according to claim 1 further including a corresponding plurality of coaxial cables interconnecting the plurality of low noise block means to the plurality of power modules and a coaxial cable spool connected to the servo drive shaft for selectively storing coaxial cable portions excessive to the rotation requirements.

3. A LNB feedhorn system comprising: a first and second support means, means mounted on the first support means and connected to the second support means for rotating the second support means, low noise block means and waveguide means electrically connected together for processing modulated RF energy having a preselected polarization, said waveguide means including a waveguide and a probe mounted in the waveguide for connecting modulated RF energy in the waveguide to the low noise block means, said low noise block means and waveguide of the waveguide means being connected to the second support means whereby when the second support means is rotated the low noise block means and the waveguide of the waveguide means is rotated for positioning the probe of the waveguide means with respect to the polarization of the modulated RF energy.

4. A LNB feedhorn system according to claim 3 further comprising a housing having an exterior surface and at least one power module attached to the exterior surface of the housing, said power module including a transient voltage suppressor and a voltage regulator electrically connected to the low noise block means and adapted for connection to a remotely positioned receiver or transmitter or both for protecting the low noise block means from any transient voltage received and heat generated by the voltage regulator, respectively.

5. A multiband integrated LNB feedhorn system having first and second support means, means mounted on the first support means for rotating the second support means, a plurality of low noise block means, a plurality of waveguide means including a plurality of energy probe means electrically connected to the plurality of low noise block means for processing modulated RF energy and a plurality of waveguides connected to the plurality of energy probe means, said plurality of waveguides and plurality of low noise block means being connected to the second support means for rotation therewith for polarization positioning of the plurality of energy-probe means thereby eliminating additional polarizing elements in the energy probe means for polarization selection and the loss of energy attending their use, focusing means connected to one of the plurality of waveguides for focusing the modulated RF energy, and defocusing means connected to a selected one of the plurality of waveguides for defocusing a selected band of modulated RF energy to provide a wider than typical half power beamwidth for increasing aiming accuracy without substantially affecting its gain.

* * * * *